US009948028B2

(12) United States Patent
Dombrowski et al.

(10) Patent No.: US 9,948,028 B2
(45) Date of Patent: Apr. 17, 2018

(54) CATCH STRUCTURE OF LATCH FOR CONNECTOR

(71) Applicant: J.S.T. CORPORATION, Farmington Hills, MI (US)

(72) Inventors: Ryan Dombrowski, Ann Arbor, MI (US); Franklin A. Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 11 days.

(21) Appl. No.: 15/404,446

(22) Filed: Jan. 12, 2017

(65) Prior Publication Data

US 2017/0207573 A1 Jul. 20, 2017

Related U.S. Application Data

(60) Provisional application No. 62/279,094, filed on Jan. 15, 2016.

(51) Int. Cl.

| | |
|---|---|
| ***H01R 13/28*** | (2006.01) |
| ***H01R 13/64*** | (2006.01) |
| ***H01R 13/627*** | (2006.01) |
| ***H01R 24/84*** | (2011.01) |
| *H01R 107/00* | (2006.01) |

(52) U.S. Cl.

CPC ..... *H01R 13/6273* (2013.01); *H01R 24/84* (2013.01); *H01R 2107/00* (2013.01); *H01R 2201/26* (2013.01)

(58) Field of Classification Search

CPC ..... H01R 13/6272; H01R 13/639; H01R 13/4362; H01R 13/50; H01R 13/629; H01R 13/631; H01R 13/64

USPC ..... 439/352, 358, 353, 357

See application file for complete search history.

(56) References Cited

U.S. PATENT DOCUMENTS 4,734,052 A * 3/1988 Vandame ..... H01R 23/27 439/293
6,146,183 A * 11/2000 Jinno ..... H01R 13/6272 439/358
6,669,398 B2 * 12/2003 Wada ..... C08J 9/0004 403/322.4
7,033,201 B2 * 4/2006 Ichida ..... H01R 13/633 439/352

(Continued)

FOREIGN PATENT DOCUMENTS

EP 0 418 782 A2 3/1991

OTHER PUBLICATIONS

U.S. Appl. No. 15/381,356 by Ryan Dombrowski, et al., filed Dec. 16, 2016.

*Primary Examiner* — Michael A Lyons
*Assistant Examiner* — Matthew T Dzierzynski
(74) *Attorney, Agent, or Firm* — Kratz, Quintos & Hanson, LLP

(57) ABSTRACT

A catch structure useful for electrical connectors has a main latch arm having two arms and a crossbar in an H shape, connected to a housing, with a primary depression surface on the ends of the arms and a beam protruding from the crossbar having a female catch. The female catch can engage with a corresponding male catch on a mating housing. Depressing the primary depression surface can disengage the catch. The catch structure can be used on hermaphroditic or non-hermaphroditic connectors and is of use in automotive applications.

2 Claims, 4 Drawing Sheets

(56) References Cited

U.S. PATENT DOCUMENTS

| | | | | |
|---|---|---|---|---|
| 7,160,134 | B2 * | 1/2007 | Ichida | H01R 13/633<br>439/352 |
| 7,682,181 | B1 * | 3/2010 | Jones, Jr. | H01R 13/6272<br>439/352 |
| 8,882,528 | B2 * | 11/2014 | Sasho | H01R 13/6335<br>439/358 |
| 9,583,876 | B2 * | 2/2017 | Sekino | H01R 13/62933 |
| 2002/0168901 | A1 | 11/2002 | Choumach | |
| 2006/0178029 | A1 | 8/2006 | Fabian | |
| 2016/0164224 | A1 * | 6/2016 | Sekino | H01R 13/6272<br>439/352 |

* cited by examiner

CATCH STRUCTURE OF LATCH FOR CONNECTOR

CROSS-REFERENCE TO RELATED APPLICATIONS

This application claims priority of provisional application U.S. Ser. No. 62/279,094, filed on Jan. 15, 2016.

STATEMENT REGARDING FEDERALLY SPONSORED RESEARCH OR DEVELOPMENT

None

THE NAMES OF PARTIES TO A JOINT RESEARCH AGREEMENT

None

STATEMENT REGARDING PRIOR DISCLOSURES BY THE INVENTOR OR A JOINT INVENTOR

None

BACKGROUND OF THE INVENTION

Field of the Invention

The present invention generally relates to the field of electrical connectors with additional means to cause or prevent unlatching, which are useful in automotive applications.

Description of the Related Art

Electrical connectors are commonly used in the automotive industry to hold electrical terminals. Two connectors, each holding terminals, are connected to each other, thereby connecting the terminals. Electrical connectors generally have latches to keep the two connectors from separating.

A hermaphroditic (genderless) electrical connector is a connector that can mate with an identical connector that is rotated 180° so that the connectors face each other. A hermaphroditic connector will generally have a latch, and therefore a pair of hermaphroditic connectors will have two latches, with portions of each latch on each connector.

BRIEF SUMMARY OF THE INVENTION

A latch structure useful for electrical connectors has a first housing having a main latch arm. The main latch arm has two arms and a crossbar in an H shape, and is connected to the housing by two base portions at respective ends of the two arms. There is a primary depression surface connected to the opposite ends of the two arms from the ends connected to the housing. A beam protrudes beam the crossbar, and the beam has a female catch for engaging with a corresponding male catch on a mating housing. The catch structure also includes a second housing that can be mated with the first housing. The second housing has a tab shaped so as to fit between the two bases of the first housing, and there is a male catch on the tab for engaging the female catch of the first housing.

The latch structure can be applied to a hermaphroditic connector by having the main latch arm on one side of the housing of the hermaphroditic connector and the tab and male catch on the other opposite of the housing, such that the two male catches engage the two female catches when two of the hermaphroditic connectors are mated.

The catch structure is useful in automotive connectors for electrical terminals.

DETAILED DESCRIPTION OF THE INVENTION

Figure 1:
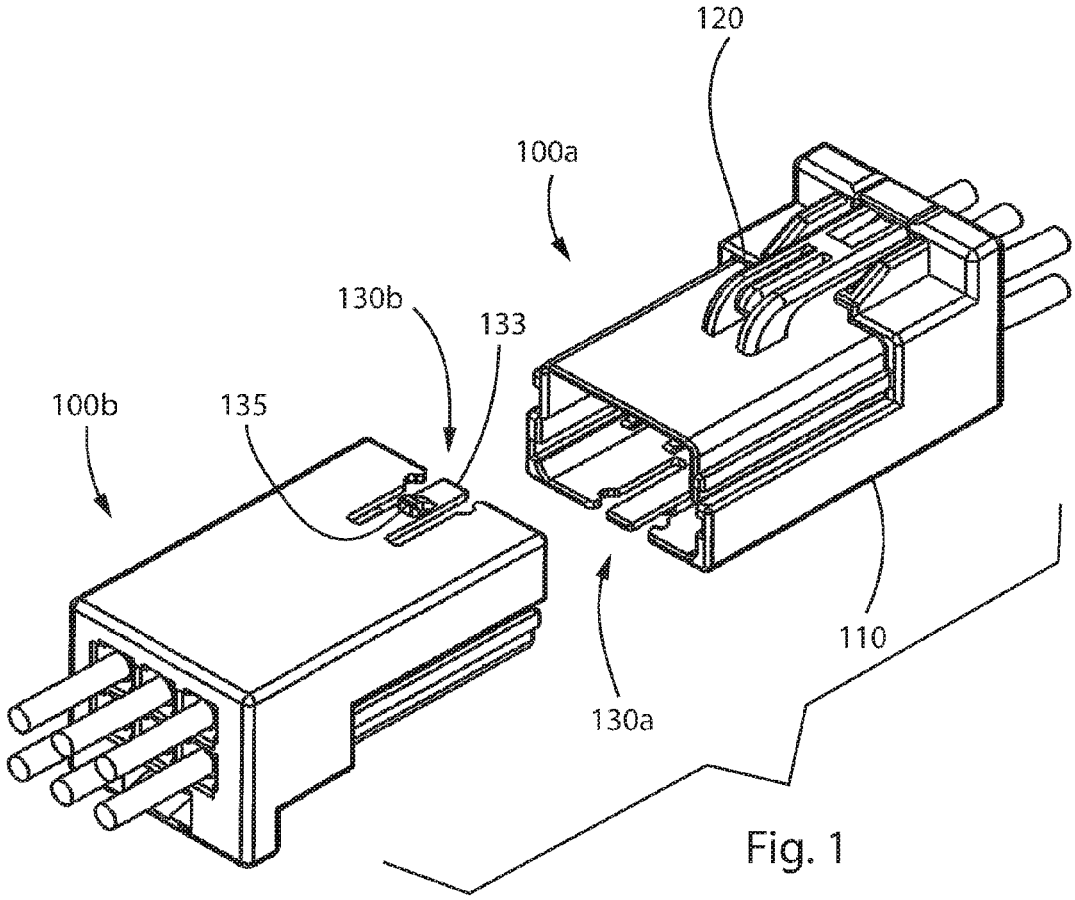
FIG. 1 illustrates an exemplary pair of hermaphroditic connectors having the latch structure of the present invention.

The catch structure of the present invention can be used to latch two different items together, and is particularly useful for latching electrical connectors. FIG. 1 illustrates the catch structure in use on a hermaphroditic connector. A hermaphroditic connector will generally have a first portion of the catch on one side of the housing of the connector and a second portion of the catch on the other side of the housing, such that there will be two catch structures, one on either side, when two of the hermaphroditic connectors are mated. It will be understood that the catch structure can also be used in non-hermaphroditic connectors, in which one connector would have at least one first portion of the catch structure and the mating connector would have at least one second portion to engage the first portion.

FIG. 1 illustrates an exemplary pair of hermaphroditic connectors 100*a*, 100*b* each having the catch structure of the present invention. The hermaphroditic connectors are identical in structure to each other, and are shown with one connector rotated 180° relative to the other, aligned for mating. Each connector has a housing 110 including a first portion 120 of a latch on one side of the housing and a second portion 130 of a latch on the other side of the housing. FIG. 1 illustrates that the first portion 120 of connector 100*a* is aligned with the second portion 130 of connector 100*b*. When the connectors 100*a*, 100*b* are mated, each first portion 120 of the latch will engage the corresponding second portion 130*a*, 130*b* of the latch. The first portion of the latch of connector 100*b* is not visible in FIG. 1.

Figure 2:
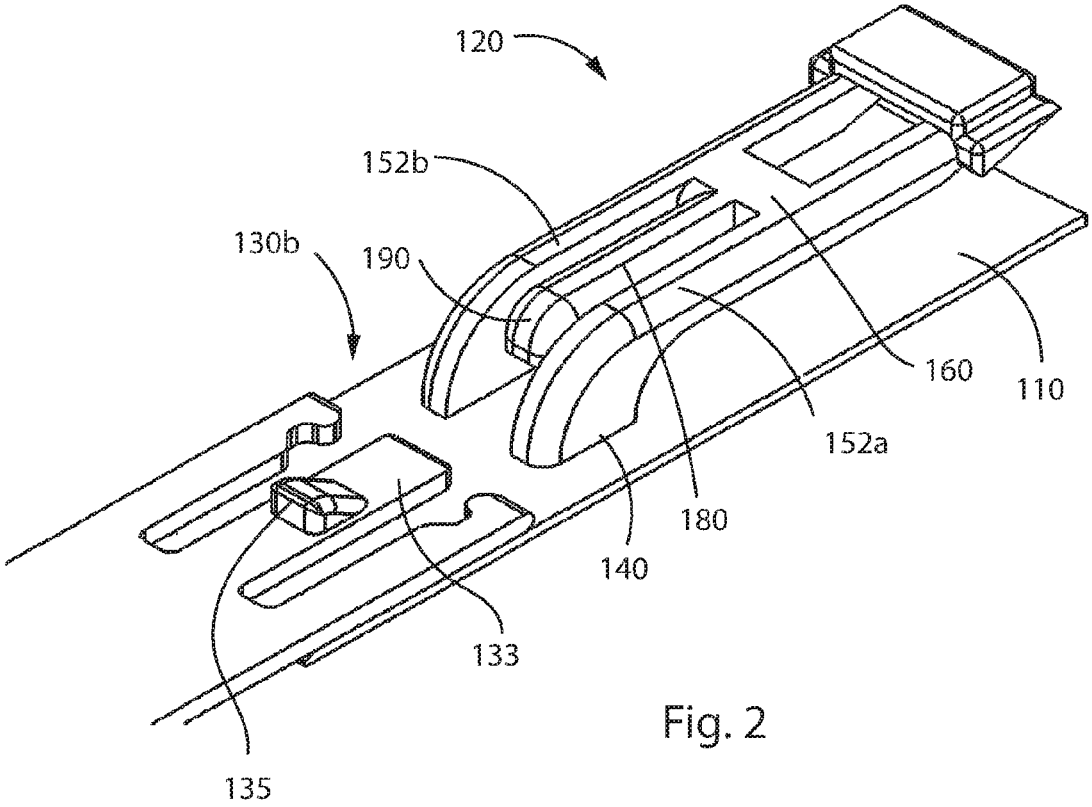
FIG. 2 is a detailed view of portions of the hermaphroditic connectors of FIG. 1, illustrating the latch structure in more detail.

FIG. 2 illustrates a more detailed version of the first portion 120 of the latch structure. The first portion 120 includes a main latch arm 150. Main latch arm 150 is constructed in an "H" shape including two arms 152*a*, 152*b* and crossbar 160 connecting the two arms 152*a*, 152*b* of main latch arm 150. At ends of arms 152*a* and 152*b* are bases 140, which connect the arms to the outer face of housing 110. Each of bases 140 contacts housing 110, thereby connecting the main latch arm 150 to housing 110. At the opposite end of main latch arm 150 from bases 140 is primary depression surface 170. Main latch arm 150, in its resting state, rests above the outer face of housing 110. When pressure is applied to primary depression surface 170, main latch arm 150 can flex toward housing 110. Latch arm 150 will generally be made of a resin material that allows flexing.

Beam 180 protrudes from crossbar 160 parallel to and between arms 152*a* and 152*b* and away from primary depression surface 170, that is, generally toward the region between bases 140. At the end of beam 180, in a region generally above the portion of housing 110 between the bases 140, is female catch 190. Female catch 190 has a female catch portion on the side facing the housing 110, which will engage with a corresponding male catch 135 on first latch portion 130 on the mating connector.

The second portion 130 of the latch includes a tab 133 that includes male catch 135, is located on the opposite side of housing 110 from the first portion 120 of the latch.

Figure 3A:
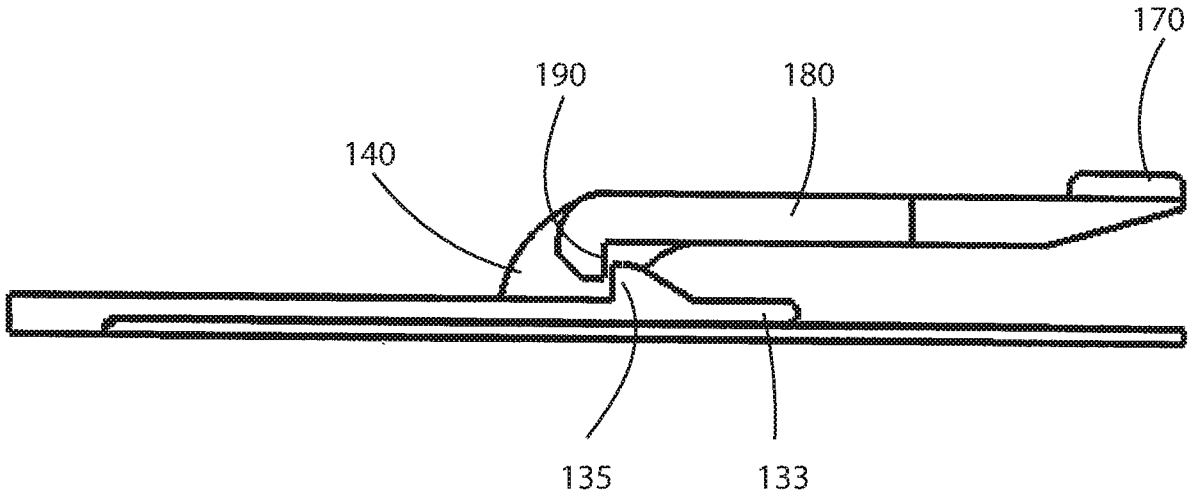
FIG. 3A is a cutaway view cross-sectional view of a portion of two mated connectors, illustrating the latch structure of the present invention while mated.

FIG. 3A is a cutaway cross-sectional view of a portion of two mated connectors, illustrating the latch structure of the present invention while mated. As seen in FIG. 3A, female catch 190 is engaged with male catch 135, and the two connectors cannot be decoupled by pulling them apart. Male catch 135 extends out from the housing 110 of the mating connector such that when coupled, interfering surfaces on female catch 190 and male catch 135 prevent decoupling until the primary deflection surface is depressed.

Figure 3B:
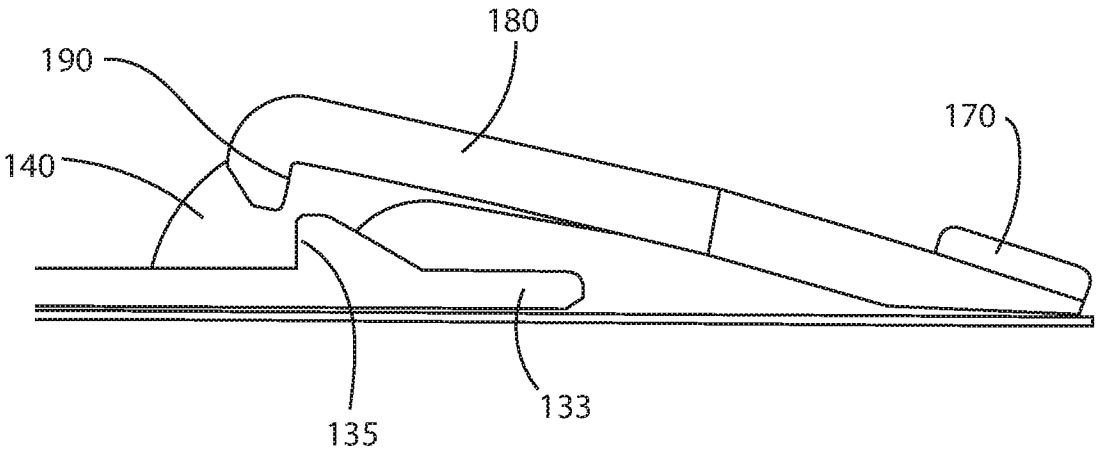
FIG. 3B is a cutaway view cross-sectional view of a portion of two connectors in the process of being uncoupled, illustrating the latch structure of the present invention during uncoupling.

FIG. 3B is a cutaway cross-sectional view of a portion of two connectors in the process of being uncoupled, illustrating the latch structure of the present invention during uncoupling.

As seen in FIG. 3B, when decoupling (unmating) two mated connectors, the primary depression surface 170 is pressed downward (toward the housing 110) by a user. When the primary depression surface 170 is pressed downward, the angle of crossbar 160 changes with respect to the surface of housing 110. The beam 180 acts to increase the deflection of the female catch 190, allowing female catch 190 to move past male catch 135. The two connectors can then be uncoupled from each other.

The process for decoupling two mated connectors having the latch structure of the invention therefore involves the step of pressing downward on primary depression surface 170, and then pulling the two connectors apart.

The described latch structure can be used on a variety of different connector housings, whose structure is not otherwise limited. Any other features commonly found in connectors may be present on the connectors incorporating this latch structure. The connectors can be hermaphroditic or not hermaphroditic, but the latch structure of the invention is particularly useful for hermaphroditic connectors.

LIST OF REFERENCE NUMERALS

100*a*, 100*b* Hermaphroditic connector
110 Housing
120 First portion of latch
130*a*, 130*b* Second portion of latch
133 Tab
135 Male catch
140 Base
150 Main latch arm
152*a*, 152*b* Arms
160 Crossbar
170 Primary depression surface
180 Beam
190 Female Catch

The invention claimed is:

1. A latch structure for an electrical connector, the latch structure comprising:

a first housing;

a main latch arm, comprising two arms and a crossbar in an H shape;

two base portions connected to the first housing, the base portions connected respectively to ends of each of the two arms, so as to connect the main latch arm to the first housing;

a primary depression surface connected to the opposite ends of the two arms from the ends connected to the base portions;

a beam protruding from said crossbar in between and parallel to the two arms and away from the primary depression surface; and a female catch at an end of the beam, said female catch being located between the two base portions; and a second housing that can be mated with said first housing, said second housing having a tab shaped so as to fit between said two bases of the first housing; and a male catch on the tab;

said male catch of the first latch portion being structured so as to engage said female catch when the first housing is mated with the second housing.

2. A latch structure for a hermaphroditic connector, comprising:

a housing, said housing having a hermaphroditic structure such that it can hermaphroditically mate with another housing having the same structure, said housing comprising:

a first side and a second side on the opposite side of the housing from the first side;

a main latch arm, comprising two arms and a crossbar in an H shape;

two base portions connected to the first side of the housing, the base portions connected respectively to ends of each of the two arms, so as to connect the main latch arm to the first side of the housing;

a primary depression surface connected to the opposite ends of the two arms from the ends connected to the base portions;

a beam protruding from said crossbar in between and parallel to the two arms and away from the primary depression surface; and a female catch at an end of the beam, said female catch being located between the two base portions; and a tab on the second side of the housing shaped so as to fit between the two bases of a mating hermaphroditic connector; and a male catch on the tab;

said male catch of the first latch portion being structured so as to engage said female catch when said housing is hermaphroditically mated with another housing having the same structure.

* * * * *